US007820761B2

(12) United States Patent
Lichtenhan et al.

(10) Patent No.: US 7,820,761 B2
(45) Date of Patent: Oct. 26, 2010

(54) METALLIZED NANOSTRUCTURED CHEMICALS AS CURE PROMOTERS

(75) Inventors: Joseph D. Lichtenhan, Petal, MS (US); Joseph J. Schwab, Huntington Beach, CA (US); Xuan Fu, Purvis, MS (US); Hendrikus C. L. Abbenhuis, Eindhoven (NL); Paul Wheeler, Hattiesburg, MS (US)

(73) Assignee: Hybrid Plastics, Inc., Hattiesburg, MS (US)

( * ) Notice: Subject to any disclaimer, the term of this patent is extended or adjusted under 35 U.S.C. 154(b) by 970 days.

(21) Appl. No.: 11/537,306

(22) Filed: Sep. 29, 2006

(65) Prior Publication Data

US 2010/0125123 A1 May 20, 2010

Related U.S. Application Data

(63) Continuation-in-part of application No. 11/015,185, filed on Dec. 17, 2004, and a continuation-in-part of application No. 11/466,053, filed on Aug. 21, 2006, now Pat. No. 7,612,143, which is a continuation-in-part of application No. 11/225,607, filed on Sep. 12, 2005, now Pat. No. 7,553,904, which is a continuation-in-part of application No. 11/166,008, filed on Jun. 24, 2005, now abandoned, which is a continuation-in-part of application No. 09/631,892, filed on Aug. 4, 2000, now Pat. No. 6,972,312, and a continuation of application No. 10/351,292, filed on Jan. 23, 2003, now Pat. No. 6,933,345, which is a continuation-in-part of application No. 09/818,265, filed on Mar. 26, 2001, now Pat. No. 6,716,919, which is a continuation-in-part of application No. 09/747,762, filed on Dec. 21, 2000, now Pat. No. 6,911,518, said application No. 11/166,008 is a continuation-in-part of application No. 10/186,318, filed on Jun. 27, 2002, now Pat. No. 6,927,270.

(60) Provisional application No. 60/722,332, filed on Sep. 29, 2005, provisional application No. 60/531,458, filed on Dec. 18, 2003, provisional application No. 60/709,638, filed on Aug. 19, 2005, provisional application No. 60/608,582, filed on Sep. 10, 2004, provisional application No. 60/147,435, filed on Aug. 4, 1999, provisional application No. 60/351,523, filed on Jan. 23, 2002, provisional application No. 60/192,083, filed on Mar. 24, 2000, provisional application No. 60/171,888, filed on Dec. 23, 1999, provisional application No. 60/301,544, filed on Jun. 27, 2001.

(51) Int. Cl.
*C08F 8/00* (2006.01)

(52) U.S. Cl. ..... 525/101; 525/403; 525/431; 525/446; 525/450; 525/453; 525/464; 525/474; 525/476; 525/479

(58) Field of Classification Search ..... 525/101, 525/403, 431, 446, 450, 453, 464, 474, 476, 525/479

See application file for complete search history.

(56) References Cited

U.S. PATENT DOCUMENTS

| | | | | |
|---|---|---|---|---|
| 4,898,907 | A * | 2/1990 | Haluska et al. | 524/490 |
| 5,047,492 | A | 9/1991 | Weidner et al. | |
| 5,194,928 | A * | 3/1993 | Cronin et al. | 257/629 |
| 5,412,053 | A | 5/1995 | Lichtenhan et al. | |
| 5,472,927 | A | 12/1995 | Mulder et al. | |
| 5,484,867 | A | 1/1996 | Lichtenhan et al. | |
| 5,589,562 | A | 12/1996 | Lichtenhan et al. | |
| 5,630,786 | A | 5/1997 | Griffin et al. | |
| 5,750,741 | A | 5/1998 | Crocker et al. | |
| 5,858,544 | A | 1/1999 | Banaszak et al. | |
| 5,891,930 | A | 4/1999 | Lapin et al. | |
| 6,100,417 | A | 8/2000 | Lichtenhan et al. | |
| 6,127,557 | A | 10/2000 | Van Santen et al. | |
| 6,194,485 | B1 | 2/2001 | Hogan et al. | |
| 6,207,364 | B1 | 3/2001 | Takamuki et al. | |
| 6,248,916 | B1 | 6/2001 | Kane et al. | |
| 6,362,279 | B2 | 3/2002 | Lichtenhan et al. | |
| 6,425,936 | B1 | 7/2002 | Sammons et al. | |
| 6,441,210 | B1 | 8/2002 | Van Tol et al. | |
| 6,517,958 | B1 | 2/2003 | Sellinger et al. | |
| 6,518,357 | B1 | 2/2003 | Rajagopalan et al. | |

(Continued)

FOREIGN PATENT DOCUMENTS

EP 121053 10/1984

(Continued)

OTHER PUBLICATIONS

Bilmeyer, W., Jr. , *Textbook of Polymer Science*, 3rd ed., Wiley & Sons, New York, Ch. 6, pp. 471-472.

(Continued)

*Primary Examiner*—Bernard Lipman
(74) *Attorney, Agent, or Firm*—David H. Jaffer; Pillsbury Winthrop Shaw Pittman LLP

(57) ABSTRACT

Metallized polyhedral oligomeric silsesquioxanes and metallized polyhedral oligomeric silicates are used as cure promoters, catalysts, and alloying agents for the reinforcement of polymer microstructures, including polymer coils, domains, chains, and segments, at the molecular level. Because of their tailorable compatibility with polymers, polyhedral oligomeric metallosesquioxanes (POMS) can be readily and selectively incorporated into polymers by common mixing processes.

25 Claims, 8 Drawing Sheets

U.S. PATENT DOCUMENTS

| | | | | |
|---|---|---|---|---|
| 6,569,932 | B2 | 5/2003 | Hsiao et al. | |
| 6,583,432 | B2 | 6/2003 | Featherby et al. | |
| 6,716,919 | B2 | 4/2004 | Lichtenhan et al. | |
| 6,723,806 | B2 * | 4/2004 | Van Tol et al. | 526/113 |
| 6,767,930 | B1 | 7/2004 | Svejda et al. | |
| 6,838,508 | B2 | 1/2005 | Hsiao et al. | |
| 2002/0052434 | A1 | 5/2002 | Lichtenhan et al. | |
| 2002/0137625 | A1 * | 9/2002 | Jost et al. | 502/158 |
| 2002/0192980 | A1 | 12/2002 | Hogle et al. | |
| 2004/0004196 | A1 | 1/2004 | DeMeo et al. | |
| 2004/0097663 | A1 | 5/2004 | Deforth et al. | |
| 2004/0170694 | A1 | 9/2004 | Colie et al. | |
| 2004/0260085 | A1 | 12/2004 | Kriesel et al. | |
| 2005/0010012 | A1 | 1/2005 | Jost et al. | |
| 2005/0192364 | A1 * | 9/2005 | Lichtenhan et al. | 521/50 |

FOREIGN PATENT DOCUMENTS

| | | |
|---|---|---|
| EP | 967229 | 12/1999 |
| WO | WO 97/24344 | 7/1997 |
| WO | WO 98/46352 | 1/1998 |
| WO | WO 99/03581 | 1/1999 |
| WO | WO 01/72885 | 10/2001 |
| WO | WO 03/082465 | 10/2003 |

OTHER PUBLICATIONS

Haddad, T.S., et al., "The Incorporation of Transition Metals into Polyhedral Oligosilsequioxane Polymers", *J. Inorg. Organomet. Polm.*, 1995, 5:3, p. 237 et al.

Hanssen, Rob W.J.M., et al., The Dynamic Status Quo of Polyhedral Silsesquioxane Coodination Chemistry, *Eur. J. Inorg. Chem.*, 2004, pp. 675-683.

Hilson, S.D., et al., "Cages, Baskets, Ladders and Tubes: Conformational Studies of Polyhedral Oligomeric Silsesquioxanes", *J. Phys. Chem.*, 2005, vol. 109, pp. 8371-8378.

Lee, A., et al., "New Approach in the Synthesis of Hybrid Polymers Grafted with Polyhedral Oligomeric Silsesquioxane and their Physical and Viscoelastic Properties", *Macromolecules*, 2004, 7 pages.

International Search Report issued Aug. 8, 2007 in PCT/US2005/32613.

International Search Report issued Aug. 10, 2007 in PCT/US2006/03120.

International Search Report issued Oct. 23, 2007 in PCT/US06/38137.

* cited by examiner

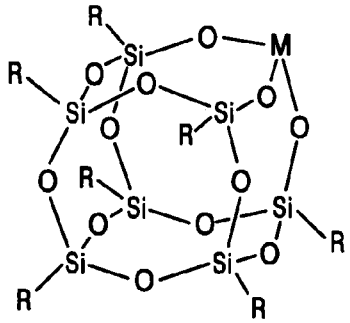
$[(RSiO_{1.5})_4(RSiO_2)_3M]\Sigma_8$
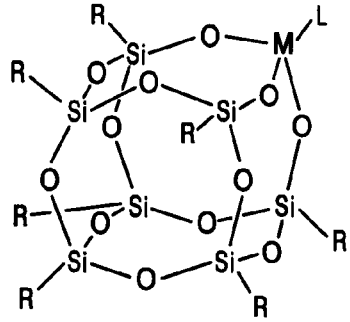
$[(RSiO_{1.5})_4(RSiO_2)_3ML]\Sigma_8$
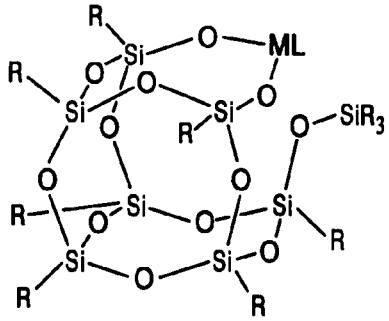
$[(RSiO_{1.5})_4(RSiO_2)_2(RSiOSiR_3)ML]\Sigma_9$
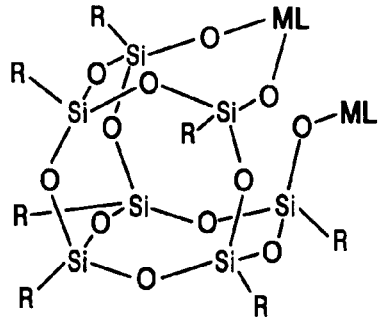
$[(RSiO_{1.5})_4(RSiO_2)_3(ML)_2]\Sigma_9$
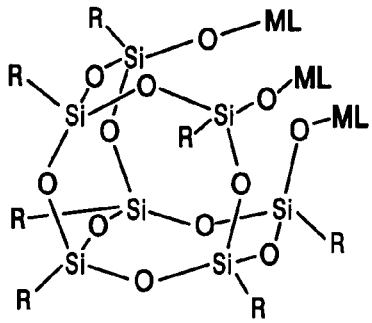
$[(RSiO_{1.5})_4(RSiO_2ML)_3]\Sigma_9$
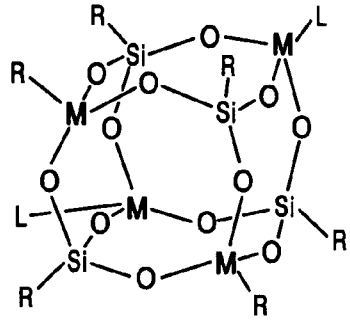
$[(RSiO_{1.5})_4(LMO_{1.5})_4]\Sigma_8$
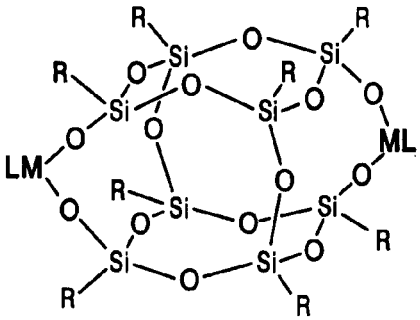
$[(RSiO_{1.5})_4(RSiO_2)_4(ML)_2]\Sigma_{10}$
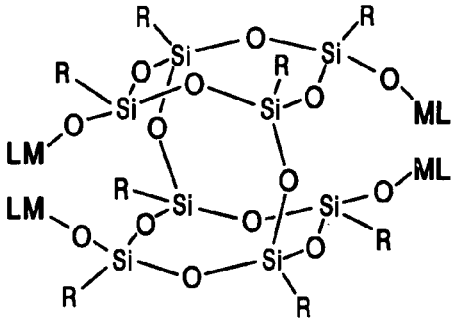
$[(RSiO_{1.5})_4(RSiO_2ML)_4\Sigma_{10}$
FIG.1/1

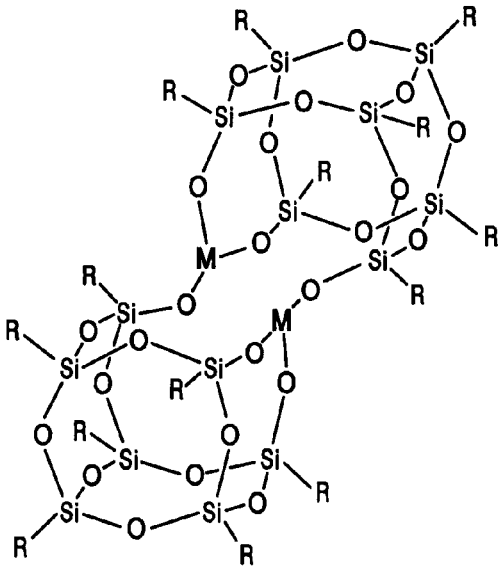
$[(RSiO_{1.5})_4(RSiO_2)_3]\Sigma_7M_2[(RSiO_{1.5})_4(RSiO_2)_3]\Sigma_7$
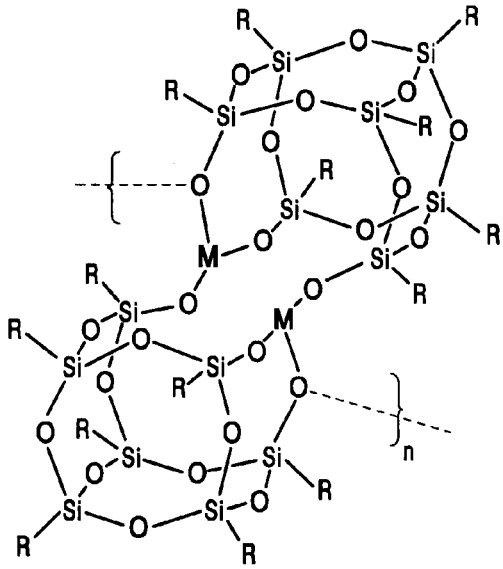
$([(RSiO_{1.5})_4(RSiO_2)_3]\Sigma_7M_2(RSiO_{1.5})_4(RSiO_2)_3]\Sigma_7)_n$
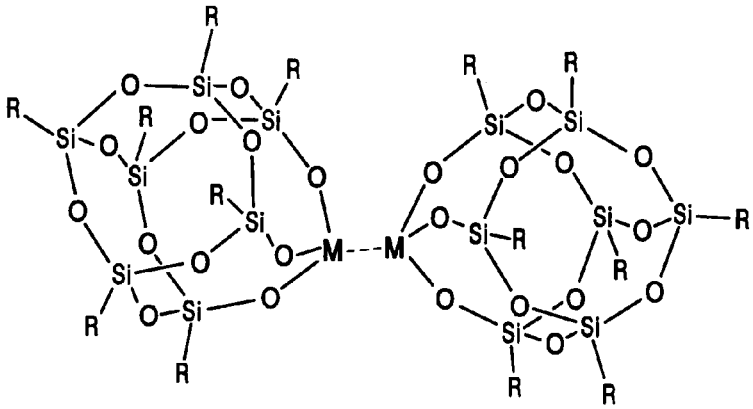
$[((RSiO_{1.5})_4(RSiO_2)_3M)_2]\Sigma_{16}$
FIG.1/2

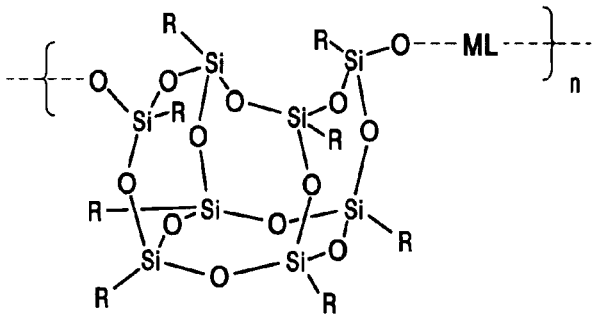
$([(RSiO_{1.5})_6(RSiO_2)_2ML]\Sigma_9)_n$
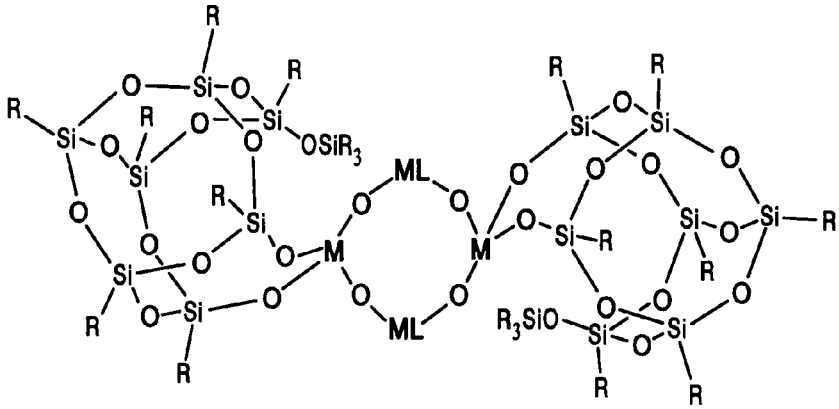
$[(RSiO_{1.5})_4(RSiO_2)_2(RSiOSiR_3)M]\Sigma_9[(O_2ML)_2]\Sigma_4[M(RSiOSiR_3)(RSiO_2)_2(RSiO_{1.5})_4]\Sigma_9$
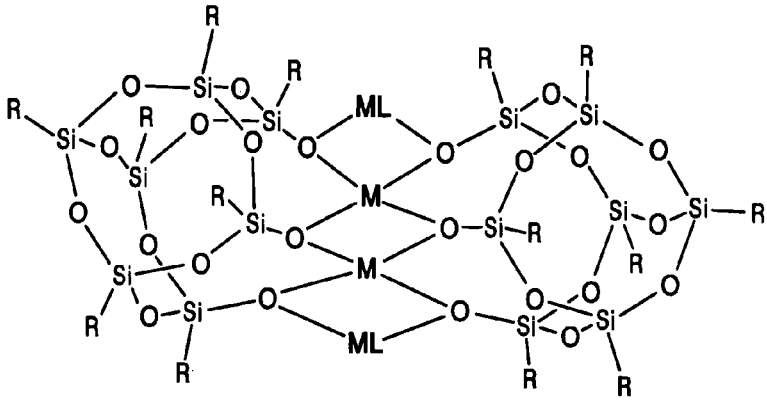
$([(RSiO_{1.5})_4(RSiO_2)_3]\Sigma_7[M_2(ML)_2]\Sigma_4[(RSiO_{1.5})_4(RSiO_2)_3]\Sigma_7$
FIG.1/3

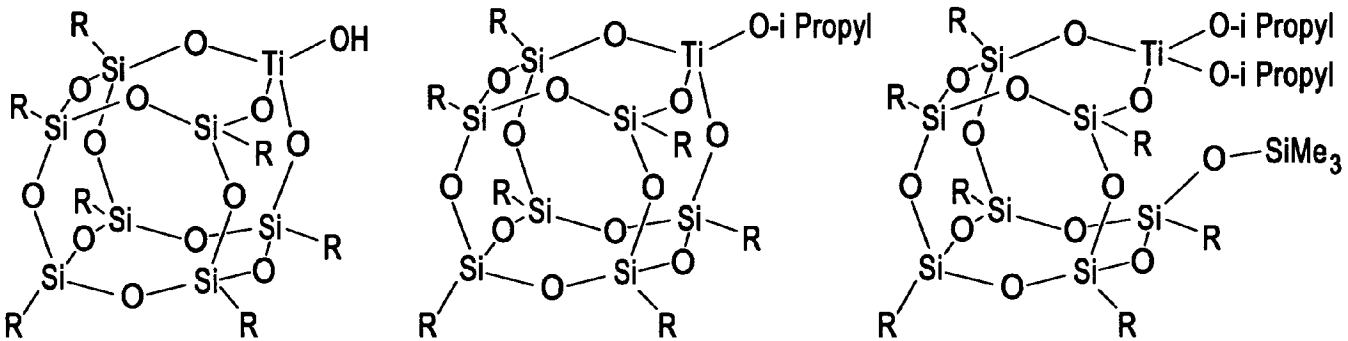
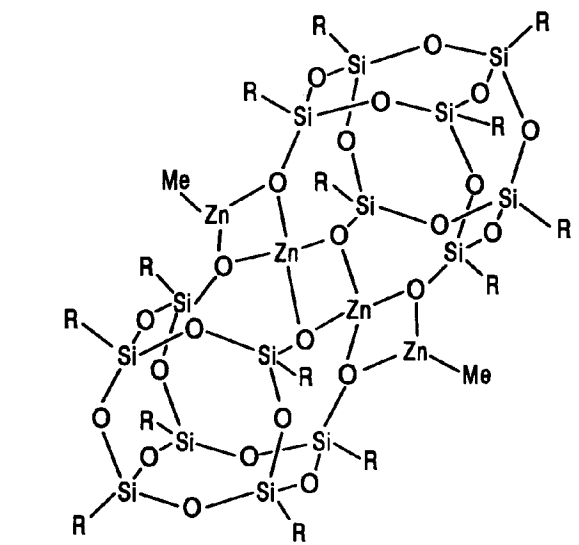
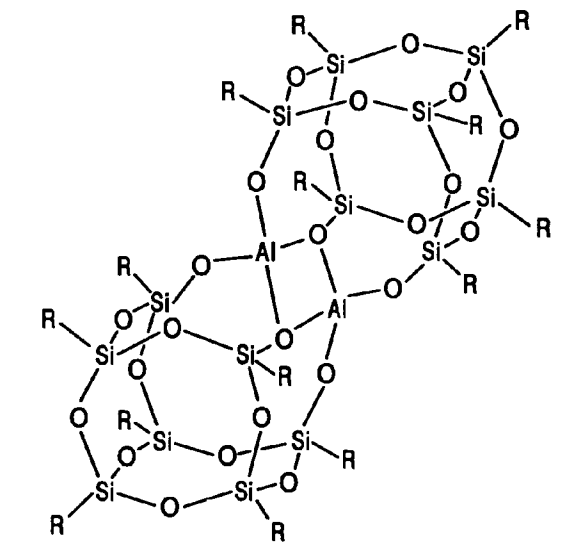
FIG.5

METALLIZED NANOSTRUCTURED CHEMICALS AS CURE PROMOTERS

CROSS-REFERENCE TO RELATED APPLICATIONS

This application claims priority from U.S. Provisional Patent Application Ser. No. 60/722,332 filed Sep. 29, 2005, is a continuation-in-part of U.S. patent application Ser. No. 11/015,185 filed Dec. 17, 2004, which claims priority from U.S. Provisional Patent Application Ser. No. 60/531,458 filed on Dec. 18, 2003, and is a continuation-in-part of U.S. patent application Ser. No. 11/466,053 filed Aug. 21, 2006, now U.S. Pat. No. 7,612,143 (which claims priority from U.S. Provisional Patent Application Ser. No. 60/709,638 filed Aug. 19, 2005), which is a continuation-in-part of U.S. patent application Ser. No. 11/225,607 filed Sep. 12, 2005, now U.S. Pat. No. 7,553,904 (which claims priority from U.S. Provisional Patent Application Ser. No. 60/608,582 filed Sep. 10, 2004), which is a continuation-in-part of U.S. patent application Ser. No. 11/166,008 filed Jun. 24, 2005, (now abandoned), which is (a) a continuation-in-part of U.S. patent application Ser. No. 09/631,892 filed Aug. 4, 2000, now U.S. Pat. No. 6,972,312 (which claims priority from U.S. Provisional Patent Application Ser. No. 60/147,435, filed Aug. 4, 1999); (b) a continuation-in-part of U.S. patent application Ser. No. 10/351,292, filed Jan. 23, 2003, now U.S. Pat. No. 6,933,345 (which claims priority from U.S. Provisional Patent Application Ser. No. 60/351,523, filed Jan. 23, 2002), which is a continuation-in-part of U.S. patent application Ser. No. 09/818,265, filed Mar. 26, 2001, now U.S. Pat. No. 6,716,919 (which claims priority from U.S. Provisional Patent Application Ser. No. 60/192,083, filed Mar. 24, 2000); (c) a continuation-in-part of U.S. patent application Ser. No. 09/747,762, filed Dec. 21, 2000, now U.S. Pat. No. 6,911,518 (which claims priority from U.S. Provisional Patent Application Ser. No. 60/171,888, filed Dec. 23, 1999); and (d) a continuation-in-part of U.S. patent application Ser. No. 10/186,318, filed Jun. 27, 2002, now U.S. Pat. No. 6,927,270 (which claims priority from U.S. Provisional Patent Application Ser. No. 60/304,544, filed Jun. 27, 2001). The disclosures of the foregoing applications are incorporated herein by reference.

FIELD OF THE INVENTION

This invention relates generally to methods for utilizing metallized nanostructured chemicals as cure promoters, catalysts, and alloying agents to improve the physical, chemical, and electronic properties of a polymer.

BACKGROUND OF THE INVENTION

It has long been recognized that the properties of polymers can be controlled to a high degree through variables such as morphology, composition, thermodynamics and processing conditions. It is similarly known that various sizes and shapes of fillers (e.g. calcium carbonate, silica, carbon black, etc.) can be incorporated into a polymer to somewhat control both polymer morphology and the resulting physical properties. Further it is known that metals are utilized to catalyze the cure (connectivity) of polymeric chains. The resulting physical properties of polymers can be controlled by the nature of the catalyst, the extent of cure, and the mechanism of cure. For example, it is well known that polyurethanes, silicones, vinyl esters, and polydienes are commonly cured through the formation of chemical crosslinks catalyzed by metals. Additionally, it is known that bismaleimides, phenolics, novolacs, dienes, and vinyl polymers can be cured through the assistance of metal catalysts.

Recent developments in nanoscience have now enabled the ability to cost effectively manufacture bulk quantities of materials that are best described as metallized nanostructured chemicals due to their specific and precise chemical formula, hybrid (inorganic-organic) chemical composition, and large physical size relative to the size of traditional chemical molecules (0.3-0.5 nm) and relative to larger sized traditional fillers (>50 nm) Nanostructured chemicals containing catalytically active metals behave as both fillers and catalysts to promote the connectivity of polymer chains between themselves and with fillers and surfaces and with the nanostructured chemical.

Nanostructured chemicals are best exemplified by those based on low-cost Polyhedral Oligomeric Silsesquioxanes (POSS) and Polyhedral Oligomeric Silicates (POS). FIG. 1 illustrates some representative examples of metallized nanostructured chemicals for which the all silicon containing systems are known as POSS and metallized systems are known as POMS. POMS (polyhedral oligomeric metallosesquioxanes) are cages that contain one or more metals inside or outside the central cage framework. In certain instances cages may contain more than one metal atom, more than one type of metal atom, or even metal alloys.

Like the all silicon containing POSS cages, POMS contain hybrid (i.e. organic-inorganic) compositions contain internal frameworks that are primarily comprised of inorganic silicon-oxygen bonds but which also contain one or more metal atoms bound to or inside of the cage (FIG. 2). In addition to the metal and silicon-oxygen framework, the exterior of a POMS nanostructured chemical is covered by both reactive and nonreactive organic functionalities (R), which ensure compatibility and tailorability of the nanostructure with organic polymers. These and other properties of metallized nanostructured POSS chemicals are discussed in detail in U.S. Pat. No. 5,589,562. Unlike metal or other particulate fillers, these metallized nanostructured chemicals have molecular diameters that can range from 0.5 nm to 5.0 nm, are of low density (>2.5 g/ml), highly dispersable into polymers and solvents, exhibit excellent inherent fire retardancy, and possess unique optical and electronic properties.

Prior art associated with fillers, plasticizers, catalysts, and polymer morphology has not been able to adequately control polymer chain, coil and segmental motion, extent of cure, or optical and electronic properties at a molecular level. Therefore, there exists a need for appropriately sized reinforcements for polymer systems with controlled diameters (nanodimensions) and distributions, and with tailorable chemical functionality.

SUMMARY OF THE INVENTION

The present invention describes methods of preparing polymer compositions by incorporating metallized nanostructured chemicals, most commonly referred to as POMS, into polymers. The resulting polymers are wholly useful by themselves, in combination with other polymers to form laminates or interpenetrating networks, or in combination with macroscopic reinforcements such as fiber, clay, glass mineral, nonmetallized POSS cages, metal particulates, and other fillers. The resulting polymers are particularly useful for producing polymeric compositions with desirable physical properties such as adhesion to polymeric, composite and metal surfaces, skin and hair, improved hydrophobicity, and surface properties. When the R groups on the POSS are wholly organic they provide water repellency, reduced melt viscosity, low dielectric constant, resistance to abrasion and fire, biological compatibility, and optical properties.

The preferred compositions presented herein contain two primary material combinations: (1) metallized nanostructured chemicals, metallized nanostructured oligomers, or metal containing nanostructured polymers from the chemical classes of polyhedral oligomeric silsesquioxanes, polyhedral oligomeric silicates, polyoxometallates, carboranes, boranes, and polymorphs of carbon; and (2) all crosslinkable polymer systems such as: styrenics, amides, nitriles, olefins, aromatic oxides, aromatic sulfides, esters, ionomers, acrylics, carbonates, epoxies, ethers, esters, silicones, imides, amides, urethanes, phenolics, cyanate esters, ureas, resoles, analines, fluoropolymers, and synthetic and natural rubber. The polymers are inclusive of systems containing functional groups, and semicrystalline, crystalline, amorphous or rubbery polymers derived from biological or natural processes.

Preferably, incorporation of the metallized nanostructured chemical (POMS) into the polymers is accomplished via blending or mixing the POMS with a polymer, prepolymer or mixture of monomers or oligomers. All types and techniques of blending and mixing, including melt blending, dry blending, solution blending, and reactive and nonreactive blending are effective.

In addition to homogeneous mixing, the selective incorporation of a nanostructured chemical into a specific region of a polymer can be accomplished by utilizing a metallized nanostructured chemical with a chemical potential (miscibility) compatible with the chemical potential of a region within the polymer. Because of their chemical nature, metallized nanostructured chemicals can be tailored to show compatibility or incompatibility with nearly all polymer systems.

Their physical size in combination with their tailorable compatibility enables metallized nanostructured chemicals to be selectively incorporated into plastics and to control the dynamics of coils, blocks, domains, segments, and subsequently favorably impact a multitude of physical, thermal and electronic properties. The properties most favorably improved are time dependent mechanical and thermal properties such as heat distortion, creep, compression set, strength, toughness, visual appearance, feel, texture, shrinkage, modulus, hardness, abrasion resistance, electrical resistance, CTE, electrical conductivity, radiation absorption, oxidative stability, hydrophobicity, biological compatibility, and biological function. In addition to mechanical properties, other physical properties that are favorably improved include thermal conductivity and electrical conductivity, fire resistance, gas barrier, and gas and moisture permeability, and print, coating, adhesion and film properties.

BRIEF DESCRIPTION OF THE DRAWINGS

FIG. 1 illustrates examples of metallized nanostructured chemicals based upon polyhedral oligomeric metallosilsesquioxanes (POMS).

FIG. 5 shows preferred POMS compositions for polyurethane catalysts and cure promoters.

DEFINITION OF FORMULA REPRESENTATIONS FOR NANOSTRUCTURES

Figure 2:
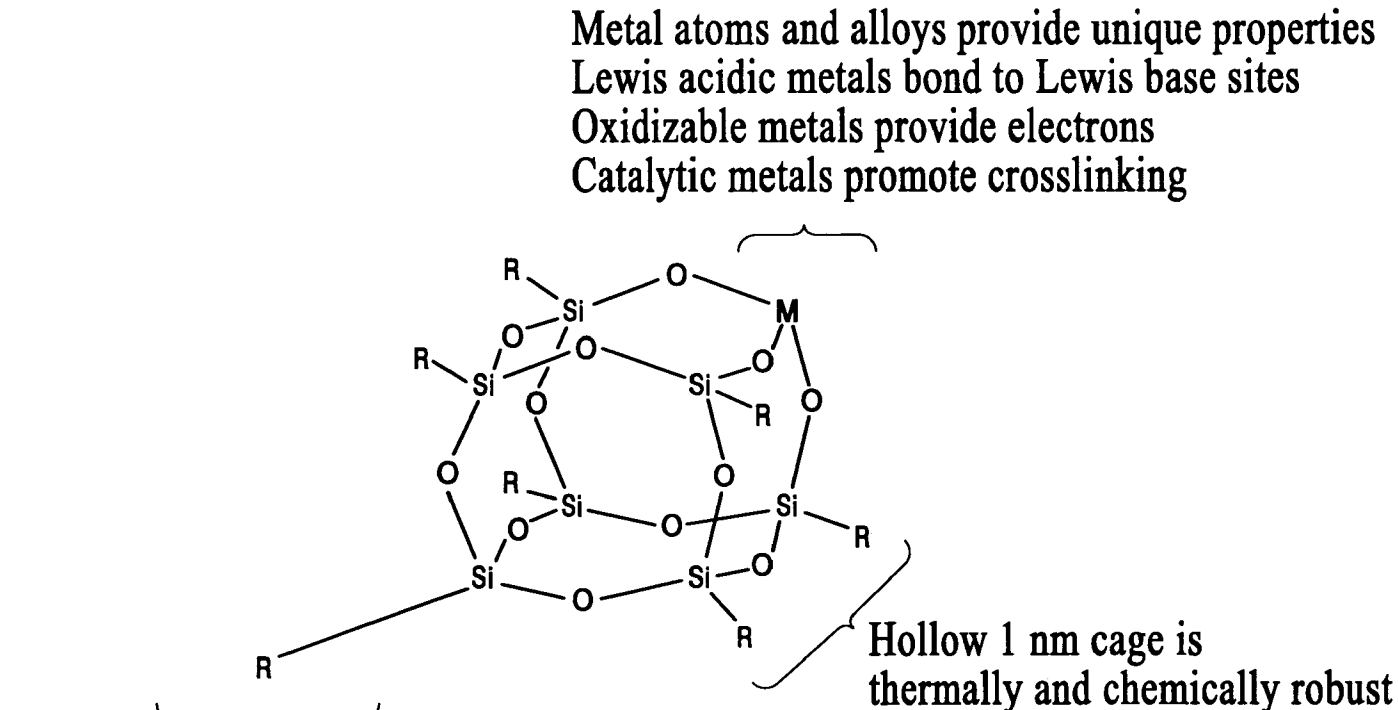
FIG. 2 shows a structural example of a metallized nanostructured chemical.

For the purposes of understanding this invention's chemical compositions, the following definition for formula representations of Polyhedral Oligomeric Silsesquioxane (POSS) and Polyhedral Oligomeric Silicate (POS) nanostructures is made.

Polysilsesquioxanes are materials represented by the formula $[RSiO_{1.5}]_{\infty}$ where $^{\infty}$ represents molar degree of polymerization and R=represents organic substituent (H, siloxy, cyclic or linear aliphatic or aromatic, or fluorinated groups that may additionally contain reactive functionalities such as alcohols, esters, amines, ketones, olefins, ethers or halides). Polysilsesquioxanes may be either homoleptic or heteroleptic. Homoleptic systems contain only one type of R group while heteroleptic systems contain more than one type of R group.

POSS and POS nanostructure compositions are represented by the formula:

$[(RSiO_{1.5})_n]_{\Sigma\#}$ for homoleptic compositions $[(RSiO_{1.5})_n(R'SiO_{1.5})_m]_{\Sigma\#}$ for heteroleptic compositions (where R≠R')

$[(RSiO_{1.5})_n(RXSiO_{1.0})_m]_{\Sigma\#}$ for functionalized heteroleptic compositions (where R groups can be equivalent or inequivalent)

$[(RSiO_{1.5})_n(RSiO_{1.0})_m(M)_j]_{\Sigma\#}$ for heterofunctionalized heteroleptic compositions In all of the above R is the same as defined above and X includes but is not limited to ONa, OLi, OK, OH, Cl, Br, I, alkoxide (OR), acetate (OOCR), peroxide (OOR), amine ($NR_2$) isocyanate (NCO), and R. The symbol M refers to metallic elements within the composition that include high and low Z metals including s and p block metals, d and f block transition, lanthanide, and actinide metals. In particular Al, B, Ga, Gd, Ce, W, Re, Ru, Nb, Fe, Co, Ni, Eu, Y, Zn, Mn, Os, Ir, Ta, Cd, Cu, Ag, V, As, Tb, In, Ba, Ti, Sm, Sr, Pd, Pt, Pb, Lu, Cs, TI, and Te are included. The symbols m, n and j refer to the stoichiometry of the composition. The symbol Σ indicates that the composition forms a nanostructure and the symbol # refers to the number of silicon atoms contained within the nanostructure. The value for # is usually the sum of m+n, where n ranges typically from 1 to 24 and m ranges typically from 1 to 12. It should be noted that Σ# is not to be confused as a multiplier for determining stoichiometry, as it merely describes the overall nanostructural characteristics of the system (aka cage size).

DETAILED DESCRIPTION OF THE INVENTION

The present invention teaches the use of metallized nanostructured chemicals as catalysts, cure promoters and alloying agents for the reinforcement of polymer coils, domains, chains, and segments of curable polymers.

The keys that enable metallized nanostructured chemicals to function as molecular level reinforcing agents, and as cure promoters are: (1) their unique size with respect to polymer chain dimensions, (2) their ability to be compatibilized with polymer systems to overcome repulsive forces that promote incompatibility and expulsion of the nanoreinforcing agent by the polymer chains, and (3) their ability to contain and distribute catalytically active metal atoms and alloys homogeneously in polymers, oligomers, and monomers.

Metallized nanostructured chemicals can be tailored to exhibit preferential affinity/compatibility with polymer microstructures through variation of the R groups on each cage or via association of the metal atom with functionality contained within the polymer (FIG. 2). At the same time metallized nanostructured chemicals can be tailored to be incompatible with microstructures within the same polymer, thus allowing for selective reinforcement of specific polymer microstructure. Therefore, the factors to effect a selective nanoreinforcement include specific cage sizes, distributions of sizes, and compatibilities and disparities between the metallized nanostrucutured chemical and the polymer system.

The catalytic activity and cure promotion attributes of metallized nanostructured chemicals can be controlled through the nature of the metal or number of metal atoms attached to or near the cage, the steric and electronic properties of the cage, and the dispersion characteristics of the cage. It is possible to control physical properties through variation of R group and POSS cage size and topology.

Nanostructured chemicals, such as the metallized POMS illustrated in FIG. 1, are available as both solids and oils. Both forms dissolve in molten polymers and solvents, thus solving the long-standing dispersion problem associated with traditional particulate fillers and cure promoting agents. Moreover, because POMS dissolve in plastics at the molecular level, the forces (i.e. free energy) from solvation/mixing are sufficient to prevent cages from forming agglomerated domains as occurs with traditional and other organofunctionalized fillers. Agglomeration of particulate fillers and catalysts has been a problem that has traditionally plagued compounders, molders, and resin manufacturers.

Table 1 lists the size range of POMS relative to polymer dimensions and filler sizes. The size of POMS is roughly equivalent to that of most polymer dimensions, thus at a molecular level the cages can effectively alter the motion of polymer chains.

TABLE 1

Relative sizes of nanostructured chemicals, polymer dimensions, and fillers.

| Particle Type | Particle Diameter |
|---|---|
| Amorphous Polymer Segments | 0.5-5 nm |
| Heptacyclohexyl POMS | 1.5 nm |
| Random Polymer Coils | 5-10 nm |
| Colloidal Silica | 9-80 nm |
| Crystalline Lamellae | 1.0-9,000 nm |
| Fillers/Organoclays | 2-100,000 nm |

The ability of POSS and POMS cages to control chain motion and to promote extent of cure is particularly apparent when they are grafted onto a polymer chain. See U.S. Pat. No. 5,412,053; U.S. Pat. No. 5,484,867; U.S. Pat. No. 5,589,562; and U.S. Pat. No. 5,047,492, all incorporated by reference. When POMS nanostructures associate with a polymer chain they act to promote the degree of cure and retard chain motion and thereby greatly enhance time dependent properties such as $T_g$, HDT, creep, modulus, hardness, and set, which correlate to increased modulus, hardness, and abrasion resistance, and durability.

The present invention demonstrates that significant property enhancements can be realized by the incorporation of catalytically active metallized nanostructured chemicals into plastics as catalysts, cure promoters, and alloying agents. This greatly simplifies the prior art. Prior art catalysts did not function as reinforcing agents nor as alloying agents within polymer morphology.

Furthermore, because metallized POSS nanostructured chemicals are single chemical entities and have discreet melting points, and dissolve in solvents, monomers and plastics, they are also effective at reducing the viscosity of polymer systems. The latter is similar to what is produced through the incorporation of plasticizers into polymers, yet with the added benefit of promoting the cure of polymers and reinforcement of the individual polymer chains due to the nanoscopic nature of the chemicals. Thus, ease of processability and reinforcement effects are obtainable through the use of metallized nanostructured chemicals (e.g. POMS) where the prior art would have required the use of both plasticizers and fillers or the covalent linking of POSS to the polymer chains.

EXAMPLES

General Process Variables Applicable to all Processes

As is typical with chemical processes, there are a number of variables that can be used to control the purity, selectivity, rate and mechanism of any process. Variables influencing the process for the incorporation of metallized nanostructured chemicals (e.g. POMS) into plastics include the size, polydispersity, and composition of the nanostructured chemical. Similarly the molecular weight, polydispersity, and composition of the polymer system must also be matched with that of the nanostructured chemical. Finally, the kinetics, thermodynamics, and processing aids used during the compounding process are also tools of the trade that can impact the loading level and degree of enhancement resulting from incorporation of nanostructured chemicals into polymers. Blending processes such as melt blending, dry blending and solution mixing blending are all effective at mixing and alloying metallized nanostructured chemical into plastics.

Example 1

Thermal Stability of POMS Catalysts

Figure 3:
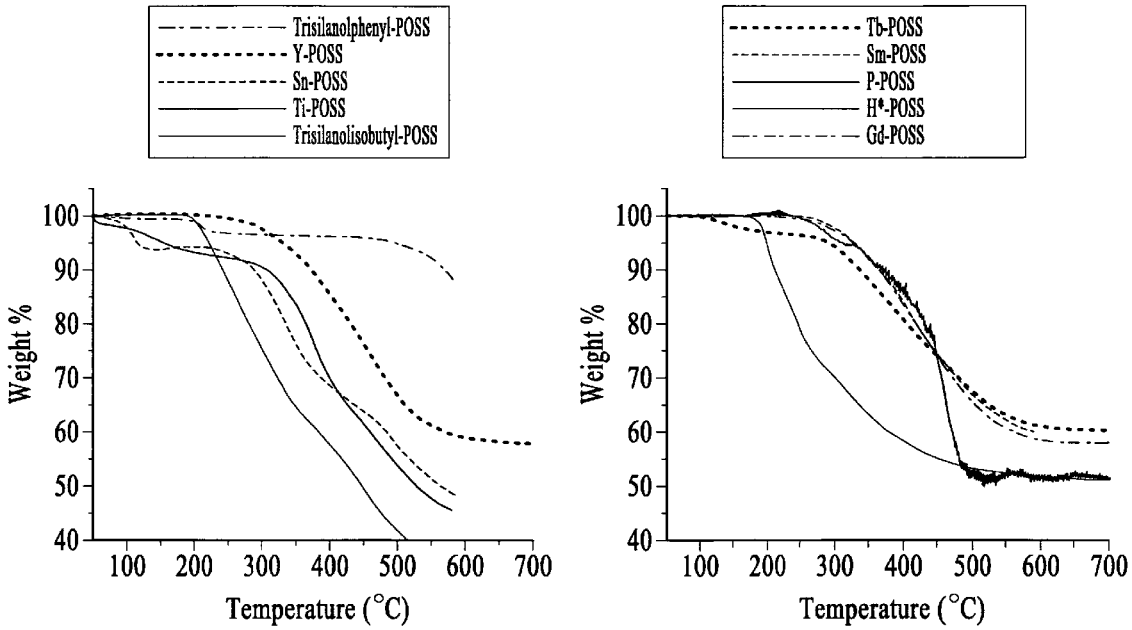
FIG. 3 shows thermogravimetric plots for various POMS.

The thermal stability of POMS was examined to determine if it could maintain its ability to catalytically promote polymer cure while not undergoing decomposition. The POMS were found to be unaffected by low temperatures and exhibited thermal stabilities up to 250° C. (480° F.) and 550° C. (1022° F.) (FIG. 3).

Example 2

Ultraviolet and Vacuum Ultraviolet Stability of POMS

Figure 4:
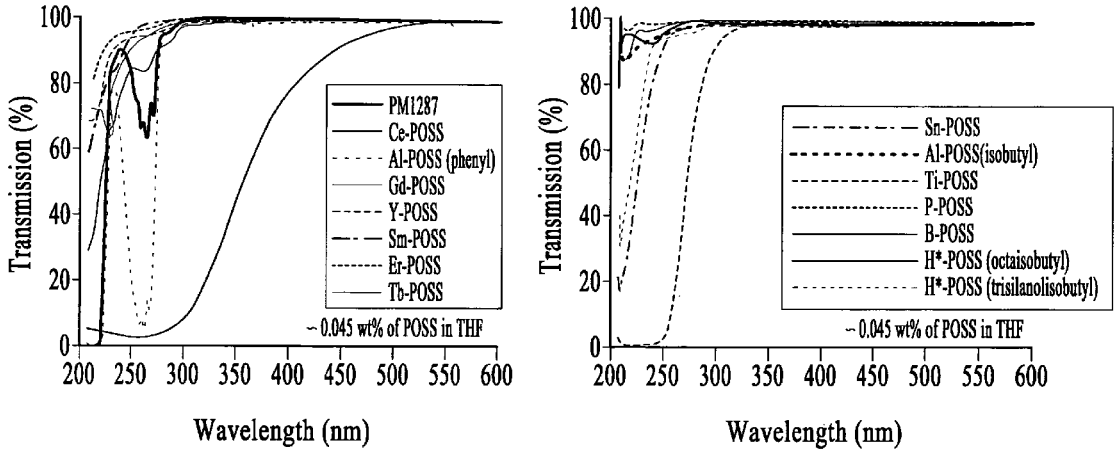
FIG. 4 provides UV-visible plots showing absorption ranges of POMS.

POMS cages are additionally beneficial in polymers because of their radiation absorbing characteristics (FIG. 4). The absorption wavelength is tunable over a wide range and highly dependant upon the nature of the R group on the cage and type of metal atom. The absorptive range coupled with the high thermal stability exceeds the performance of wholly organic absorbers and provides a new opportunity for protection of high temperature polymers, composites, and coatings from UV damage.

Example 3

Cure of Urethane Resins

A large diversity in structures and compositions for POMS exists (FIG. 1). Many of these systems are capable of functioning as catalysts and cure promoters in different resin systems. Preferred compositions for polyurethanes are $[(RSiO_{1.5})_7(HOTiO_{1.5})]_{\Sigma 8}$, $[(RSiO_{1.5})_7(i\text{-propylOTiO}_{1.5})]_{\Sigma 8}$, and $[(RSiO_{1.5})_7(Me_3SiO)(i\text{-propylO})_2TiO_{0.5})]_{\Sigma}8$ as shown in FIG. 5. The activity of POMS to polyurethane cure is possible over a range of POMS loading from 0.001% to 50 wt % with a preferred loading of 0.1% to 10%.

Cure of a Bayer 2-component polyurethane containing desmophen polyol 1150 (100 mass parts) and desmodur polyisocyanate N 75 MPA/X (70 mass parts), was carried out by mixing for one minute followed by subsequent addition of the POMS and mixing for 2 minutes followed by curing at the specified temperature. The polyurethanes were suitable for use as coatings on glass or as monolithic materials. While all catalysts promoted cure within 24-72 hours, the $[(RSiO_{1.5})_7(Me_3SiO)(i\text{-propylO})_2TiO_{0.5})]_{\Sigma 8}$ system produced a preferred smooth surface coating with optical transparency and minimal color.

Organometallic complexes are rarely considered as viable alternatives to existing polyurethane catalyst systems such as tin, amines, or mixtures thereof. The main reason that organometallic complexes are not widely used is their poor hydrolytic stability and consequently short pot-life. This is especially true for polyurethane foam systems where often 0.5 wt % or greater of water is present. All of the $[(RSiO_{1.5})_7(HOTiO_{1.5})]_{\Sigma 8}$, $[(RSiO_{1.5})_7(i\text{-propylOTiO}_{1.5})]_{\Sigma 8}$, $[(RSiO_{1.5})_7(Me_3SiO)(i\text{-propylO})_2TiO_{0.5})]_{\Sigma}8$ POMS exhibited excellent hydrolytic stability. The bulky and hydrophobic R groups on the cage effectively provide hydrophobicity to the metal atom while maintaining a high level of catalytic activity. Additionally, the R groups on the cage provide for solubilization of the POMS into the resin components. For aliphatic resin systems, aliphatic R groups on POMS are preferred while for aromatic resins, aromatic groups on POMS are preferred. POMS derivatives containing Sn are also highly active toward polyurethane cure.

Example 4

Cure of Two-Part Epoxy Resins

The preferred POMS for epoxy resins are $[(RSiO_{1.5})_{14}(AlO_{1.5})_2]_{\Sigma 18}$ and $[(RSiO_{1.5})_{14}(MeZn)2(ZnO_{1.5})_2]_{\Sigma 18}$ (where R=Ph) as shown in FIG. 5. The activity of POMS toward epoxy cure is possible over a range of POMS loading from 0.001% to 50 wt % with a preferred loading of 0.1% to 10%.

Cure of a Vantico 2-component epoxy comprised of araldite GY 764 BD bisphenol A epoxy resin (100 parts) and araldur 42 cycloaliphatic amine (23 parts) was carried out by mixing the appropriate ratio of components followed by addition and thorough mixing of the POMS component.

The epoxy resins were suitable for use as coatings, monoliths, prepregs, VARTMable resin or filament winding. While all catalysts promoted cure within 24-120 hours, the $[(PhSiO_{1.5})_{14}(AlO_{1.5})_2]_{\Sigma 18}$ system produced a preferred resin with optical transparency and minimal color.

The bulky and hydrophobic R groups on the cage effectively provide hydrophobicity to the metal atom while maintaining a high level of catalytic activity. The $[(RSiO_{1.5})14(AlO_{1.5}]_{\Sigma 18}$ POMS, where R=Ph, exhibited the best overall stability and catalytic activity. This is likely due to the high level of compatibility between the aromatic R=Ph groups on the cage and the aromatic bisphenol A component of the resin system.

Example 5

Homopolymerization Cure of Aromatic Epoxy Resins

In contrast to anhydride cured or amine cured epoxy systems, POMS can be utilized to homopolymerize epoxy resins into a network polymer with similar thermomechanical properties to conventional cure systems. In addition, the resulting polymer contains polyether linkages which provided superior moisture performance.

Two common epoxy resin monomers, diglycidalether of bisphenol A (DGEBA) and tetraglycidal diamino diphenyl methane (TGDDM), were homopolymerized with $[(RSiO_{1.5})_{14}(AlO_{1.5})_2]_{\Sigma 18}$ POMS, where R=Ph, at 150° C. for 16 hours and the resulting thermomechanical properties compared relative to the resin system cure with aromatic amine. The thermomechanical data in Table 2 shows the POMS cured systems are equivalent to the properties resulting from amine cure with the additional advantage of improved hydrophobicity. The data also show that properties improve as POMS concentration increases. This correlates to findings that POMS loading levels of approximately 0.75 mol % result in 80% conversion of available epoxide groups.

Polymerization rates of the DGEBA were faster than those with TGDDM. The POMS was found to promote room temperature gelation within 1 hour for DGEBA whereas TGDDM required heating for 2 hours at 110° C. to promote gelation. For all systems optimal thermomechanicals were obtained by heating to 150° C. Mechanical properties were found to be highly composition dependent. In general, the retainment of modulus (E') at elevated temperatures (240° C.) was found to be favorably improved through curing with POMS. The $[(PhSiO_{1.5})_{14}(MeZn)_2(ZnO_{1.5})_2]_{\Sigma 18}$ POMS was also active toward polymerization.

TABLE 2

Thermomechanical Properties of POMS Cured DGEBA and TGDDM Resin.

| Curing Agent | Mol % | Wt % | Tg (° C.) | E' @ 40° C. (Pa × $10^9$) | E' @ 240° C. (Pa × $10^8$) |
|---|---|---|---|---|---|
| DGEBA RESIN | | | | | |
| Amine | | | 152 | 1.4 | 3.25 |
| $[(PhSiO_{1.5})_{14}(AlO_{1.5})_2]_{\Sigma 18}$ | 0.25 | 1.9 | 119 | | |
| $[(PhSiO_{1.5})_{14}(AlO_{1.5})_2]_{\Sigma 18}$ | 0.5 | 3.8 | 130 | 1.35 | 4.71 |
| $[(PhSiO_{1.5})_{14}(AlO_{1.5})_2]_{\Sigma 18}$ | 0.75 | 5.7 | 138 | 1.28 | 3.88 |

TABLE 2-continued

Thermomechanical Properties of POMS Cured DGEBA and TGDDM Resin.

| Curing Agent | Mol % | Wt % | Tg (° C.) | E' @ 40° C. (Pa × $10^9$) | E' @ 240° C. (Pa × $10^8$) |
|---|---|---|---|---|---|
| TGDDM RESIN | | | | | |
| Amine | | | 183 | 1.23 | 0.53 |
| $[(PhSiO_{1.5})_{14}(AlO_{1.5})_2]_{\Sigma 18}$ | 0.13 | 1.1 | 109 | 2.21 | 0.45 |
| $[(PhSiO_{1.5})_{14}(AlO_{1.5})_2]_{\Sigma 18}$ | 0.25 | 2.3 | 162 | 1.84 | 1.54 |
| $[(PhSiO_{1.5})_{14}(AlO_{1.5})_2]_{\Sigma 18}$ | 0.38 | 3.4 | 184 | 2.21 | 2.14 |

Example 6

Homopolymerization Cure of Aliphatic Epoxy Resins

In contrast to conventional anhydride cured or amine cured epoxy systems, the $[(PhSiO_{1.5})_{14}(AlO_{1.5})_2]_{\Sigma 18}$ POMS is extremely active towards the cure of cycloaliphatic epoxies. All cycloaliphatic epoxy resin can be cured. A preferred composition is Shell ERL4221 and Hybrid Plastics EP0408 containing $[(epoxycyclohexyethylSiO_{1.5})_8]_{\Sigma 8}$ $[(epoxycyclohexyethylSiO_{1.5})_{10}]_{\Sigma 10}$, $[(epoxycyclohexyethylSiO_{1.5})_{12}]_{\Sigma 12}$, $[(epoxycyclohexyethylSiO_{1.5})_{\infty}]$. Effective POMS loadings range from 0.01 wt % to 10 wt %, with preferred loadings of 0.1% to 3%. The POMS is added to the cycloaliphatic resin with mixing and promotes room temperature polymerization to render an optically clear and hard resin with outstanding thermal properties and resistance to moisture and oxidizing agents such as steam, ozone, hydrogen peroxide. The use of POMS and cycloaliphatic epoxy resins is ideal for medical devices requiring sterilization or for electronic adhesives such as underfills and encapsulating agents. The $[(PhSiO_{1.5})_{14}(MeZn)_2(ZnO_{1.5})_2]_{\Sigma 18}$ POMS is also effective in these resin systems.

Example 7

Cure of Bismaleimide Resins

It is known that metals such as aluminum are capable of catalyzing both ene and Diels-Alder reactions, both of which occur in the cure of BMI resins. Historically the use of aluminum organometallic and inorganic compounds as catalysts for BMI resins have been thwarted by the moisture and air sensitivity of such systems. The $[(RSiO_{1.5})_{14}(AlO_{1.5})_2]_{\Sigma 18}$ POMS, where R=Ph, exhibited the best overall stability and catalytic activity in aromatic bismaleimide resins (BMI). This is likely due to the high level of compatibility between the aromatic R=Ph groups on the cage and the aromatic bisphenol A component of the resin system. Further, the $[(PhSiO_{1.5})_{14}(AlO_{1.5})_2]_{\Sigma 18}$ POMS is air and moisture stable.

Figure 6:
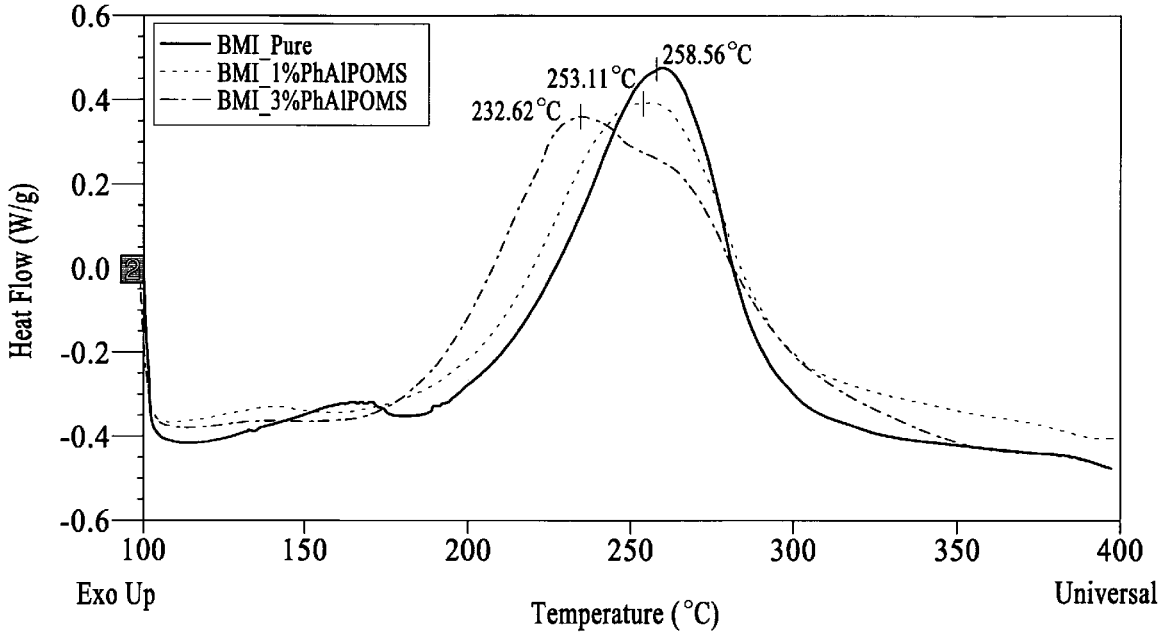
FIG. 6 is a DSC plot comparing onset of cure for POMS and non-POMS BMI.

POMS $[(PhSiO_{1.5})_{14}(AlO_{1.5})_2]_{\Sigma 18}$ was compounded into Cytec BMI resin 5250-4 in amounts ranging from 0.001% to 50% with preferred loadings of 0.1-5%. The POMS was added to premixed BMI resin via stirring and was utilized as a 1-component system, although use as a 2-component system is also envisioned. A standard cure procedure was followed to result in a BMI resin with improved thermomechanical properties. A specific advantage resulting from addition of POMS was the catalytic promotion of cure at lower temperature and more complete cure of the resin system as exhibited by direct scanning calorimetry (FIG. 6). The use of POMS to enable faster, lower temperature, and more complete cure of the resin is advantageous to realize lower cost processing and improved high temperature properties.

While certain representative embodiments and details have been shown for purposes of illustrating the invention, it will be apparent to those skilled in the art that various changes in the methods and apparatus disclosed herein may be made without departing from the scope of the invention which is defined in the appended claims.

What is claimed is:

1. A composite material comprising:

(a) a metallized nanostructured chemical selected from the group consisting of polyhedral oligomeric metallosesquioxanes and polyhedral oligomeric metallosilicates; and (b) a polymer selected from the group consisting of acrylics, carbonates, epoxies, esters, silicones, polyolefins, polyethers, polyesters, polycarbonates, polyamides, polyeurethanes, polyimides, styrenics, amides, nitriles, olefins, aromatic oxides, aromatic sulfides, esters, and iono=ers or rubbery polymers derived from hydrocarbons and silicones, wherein the metallized nanostructured chemical is compounded into the polymer by reactive or non-reactive blending, and the metallized nanostructured chemical acts as a catalyst to promote cure of the material.

2. The material of claim 1, further comprising a nonmetallized nanostructured chemical selected from the group consisting of POSS and POS compounded into the polymer by reactive or non-reactive blending.

3. The material of claim 1, wherein a plurality of metallized nanostructured chemicals is compounded into the polymer.

4. The material of claim 2, wherein a plurality of metallized nanostructured chemicals is compounded into the polymer.

5. The material of claim 4, wherein a plurality of nonmetallized nanostructured chemicals is compounded into the polymer.

6. A method of alloying a metallized nanostructured chemical selected from the group consisting of polyhedral oligomeric metallasesquioxanes and polyhedral oligomeric metallosilicates into a polymer selected from the group consisting of acrylics, carbonates, epoxies, esters, silicones, polyolefins, polyethers, polyesters, polycarbonates, polyamides, polyeurethanes, polyimides, styrenics, amides, nitriles, olefins, aromatic oxides, aromatic sulfides, esters, and ionomers or rubbery polymers derived from hydrocarbons and silicones, comprising the step of compounding the metallized nanostructured chemical into the polymer by reactive or non-reactive blending, wherein the metallized nanostructured chemical acts as a catalyst to promote cure of the material.

7. The method of claim 6, further comprising compounding a nonmetallized nanostructured chemical selected from the group consisting of POSS and POS into the polymer by reactive or non-reactive blending.

8. The method of claim 6, wherein a plurality of metallized nanostructured chemicals is compounded into the polymer.

9. The method of claim 7, wherein a plurality of metallized nanostructured chemicals is compounded into the polymer.

10. The method of claim 9, wherein a plurality of nonmetallized nanostructured chemicals is compounded into the polymer.

11. The method of claim 6, wherein the polymer is in a physical state selected from the group consisting of amorphous, semicrystalline, crystalline, elastomeric and rubber.

12. The method of claim 6, wherein the polymer contains a chemical sequence and related polymer microstructure.

13. The method of claim 6, wherein the polymer is selected from the group consisting of a polymer coil, a polymer domain, a polymer chain, and a polymer segment.

14. The method of claim 6, wherein the metallized nanostructured chemical reinforces the polymer at a molecular level.

15. The method of claim 6, wherein the compounding is nonreactive.

16. The method of claim 6, wherein the compounding is reactive.

17. The method of claim 6, wherein a physical property of the polymer is improved as a result of incorporating the metallized nanostructured chemical into the polymer.

18. The method of claim 17, wherein the physical property is selected from the group consisting of adhesion to a polymeric surface, adhesion to a composite surface, adhesion to a metal surface, water repellency, density, low dielectric constant, thermal conductivity, glass transition, viscosity, melt transition, storage modulus, relaxation, stress transfer, abrasion resistance, fire resistance, biological compatibility, gas permeability, porosity, optical quality, and radiation shielding.

19. The method of claim 6, wherein the compounding is accomplished by blending the metallized nanostructured chemical into the polymer.

20. The method of claim 19, wherein the compounding is accomplished by a blending process selected from the group consisting of melt blending, dry blending, and solution blending.

21. The method of claim 6, wherein the metallized nanostructured chemical performs at least one function selected from the group consisting of plasticizer, filler, compatabilizer, antioxidant, and stablizer.

22. The method of claim 7, wherein the metallized and nonmetallized nanostructured chemicals function as compatibilizers.

23. The method of claim 6, wherein the metallized nanostructured chemical is selectively compounded into the polymer such that the metallized nanostructured chemical is incorporated into a predetermined region within the polymer.

24. The method of claim 23, wherein a physical property is enhanced as a result of compounding the metallized nanostructured chemical into the polymer.

25. A method according to claim 24, wherein the property is selected from the group consisting of $T_g$, HDT, modulus, creep, set, and permeability.

* * * * *